United States Patent [19]

Van Meteren

[11] 4,353,162

[45] Oct. 12, 1982

[54] APPARATUS AND PROCESS FOR MANUFACTURING FINNED TUBES

[75] Inventor: Johannes Van Meteren, Roelofarendsveen, Netherlands

[73] Assignee: The Lummus Company, Bloomfield, N.J.

[21] Appl. No.: 6,738

[22] Filed: Jan. 26, 1979

[51] Int. Cl.[3] ..... B21C 37/26

[52] U.S. Cl. ..... 29/727; 29/157.3 AH; 226/112

[58] Field of Search ..... 29/157.3 AH, 727; 72/136, 419, 420, 422, 98; 226/102, 112, 158

[56] References Cited

U.S. PATENT DOCUMENTS

| | | | |
|---|---|---|---|
| 2,626,452 | 1/1953 | Gridley | 226/158 |
| 2,956,335 | 10/1960 | Matheny et al. | 29/157.3 AH |
| 3,247,696 | 4/1966 | Stikeleather | 72/136 |
| 3,568,288 | 3/1971 | Nihlen | 29/157.3 AH |
| 3,745,801 | 7/1973 | Kallfelz et al. | 72/98 |
| 3,819,073 | 6/1974 | Asselborn et al. | 226/112 |
| 3,876,488 | 4/1975 | Uemura et al. | 226/158 |

FOREIGN PATENT DOCUMENTS

| | | | |
|---|---|---|---|
| 927268 | 5/1963 | United Kingdom | 226/128 |

*Primary Examiner*—Lowell A. Larson

*Attorney, Agent, or Firm*—James N. Blauvelt; Louis E. Marn

[57] ABSTRACT

Apparatus and process for manufacturing a finned tube, said apparatus comprising a tube feed assembly which has absolute control over the rotational speed of the bare tube being processed as well as the linear feed rate thereof, a grooved roller assembly (when forming an applied fin "G" tube) to materially improve the material flow distribution of the tube during groove formation, a fin forming assembly which deforms the finning material to permit the use of thinner finning material and which compensates for fluctuations between feed rates of the finning material and rotational speed of the tube or presentation rate of the grooved tube to the deforming finning material during fin swageing, and a fin swageing assembly.

26 Claims, 7 Drawing Figures

APPARATUS AND PROCESS FOR MANUFACTURING FINNED TUBES

BACKGROUND OF THE INVENTION

This invention relates to an apparatus and process for forming finned tubes, and more particularly to a novel apparatus and process for forming applied fin "G" tubes, i.e., a fin which is continuously swaged into a groove formed in a tube, as well as for forming wrapped fin "L" and "LL" tubes.

FIELD OF THE INVENTION

With rising world population and ever greater demands on natural water resources coupled with the need to conserve water, the designers and manufacturers of process plants have experienced greater heat transfer equipment requirements. Such increased heat transfer equipment requirements reflect an increased demand for heat transfer tubes, particularly of the finned tube type.

The manufacture of finned tubes initially was directed to a tube formed with a tension-wound fin and later to the wrapping of an "L"-shaped fin about a tube member, such as described in U.S. Pat. No. 3,388,449 to McElroy, and has evolved to the manufacture of an applied fin "G" tube wherein a fin root of a fin is continuously swaged into a helical groove formed in the tube to mechanically bond the fin to the tube, such as described in U.S. Pat. No. 3,613,206 to McElroy. Applied fin "G" tubes are currently more expensive to produce than the wrapped fin "L" tubes, or double wrapped fin "LL" tubes, mainly due to the slower rotational speeds on contemporary machines, e.g., maximum RPMs of about 1000 for applied fin "G" vs. 3000 RPMs for wrapping fins tubes. Manufacture of "L" and "LL" tubes is plagued with many problems including pitch inaccuracies, air gaps resulting from uneven tension of the finning material as well as the fact that product quality is difficult to monitor. Production problems are generally detected only by product dissassembly, a costly and inefficient procedure.

For an applied fin "G" tube, the helical groove is usually formed by either plowing or rolling, depending on the high or low skin hardness of the tube, respectively, although grooving techniques are currently being used, as discussed in the above McElroy '206 Patent. Rolling of such a groove has been effected by introducing a narrow steel disc into a tube of low skin hardness as the tube is caused to rotate with generally concomitant difficulties in maintaining pitch accuracy (i.e., number of fins per unit length). Such problems result in damage to groove equipment, produce malformed grooves, as well as cause misalignment between fin and grooves as well as requiring the frequent replacement of the grooving roller.

With the skew roller frictional drive system, such as described in the aforementioned references, the linear tube rate and thus production rate (tubes/hour) is limited by the heat generated by the frictional interface between the bare tube and groove roller, let alone manual tube feed consideration requiring the stopping of the assembly for tube loading and finned tube unloading. Additionally, since most bare tubes are supplied with an oil film, slippage between drive rollers and the tube being finned result in pitch errors and a reduction in fin tension, and, in addition, for wrapped fin "L" tubes, creates air gaps between the fin root and the tube surface, thereby diminishing heat transfer efficiency as well as providing sites for corrosive activity.

The apparatus and process of the prior art produce unit lengths of finned tube from unit tube length manually introduced into the finned tube assembly. Thus, finned tube production is dependent on the shutting-down and starting-up of the finned tube assembly given manual tube feeding and finned tube removal. Concomitant with such an operation are variations in product specification and acceptance and usually finned tubes designed having unfinned end portions.

In the apparatus and process of the prior art, the finning material is deformed into a form having a tapered outwardly-inwardly cross-section to create asymmetric material deformation across the strip width generating progressive elongation towards the outer fibers which has the effect of forming the strip into a ring encircling the tube.

OBJECTS OF THE INVENTION

An object of the present invention is to provide a novel apparatus and process for forming a finned tube.

Still another object of the present invention is to provide a novel assembly and process for forming a finned tube compatible with continuous tube feeding to produce an endless (or any desired) length of wrapped or applied finned "G" tubes.

Another object of the present invention is to provide a novel apparatus and process for forming finned tubes at substantially increased rotational speeds and thus at increased production rates.

Still another further object of the present invention is to provide a novel apparatus and process for forming a finned tube of reduced fin thickness and thus having less finning material requirements.

A further object of the present invention is to provide a novel apparatus and process for forming finned tubes of greater pitch accuracy.

A still further object of the present invention is to provide a novel apparatus and process for forming finned tubes permitting greater flexibility of operation to change in a facile manner fin types as well as varying pitch specifications.

Still another object of the present invention is to provide tubes having unfinned portions at any predetermined section of the finned tube without any apparatus or process stoppage.

Another object of the present invention is to provide a novel tube drive assembly to control in a more absolute manner the tube speed and feed during the tube finning operation.

A further object of the present invention is to provide a novel groove roller assembly for a finned tube apparatus and process.

Still another object of the present invention is to provide a novel fin deformation assembly for distributing the finning material across the fin strip to assist in forming a coil around the tube.

SUMMARY OF THE INVENTION

These and other objects of the present invention are achieved by a novel apparatus and process for manufacturing finned tubes, said apparatus comprising, inter alia, a tube feed assembly which has absolute control over the rotational speed of the bare tube being processed as well as the axial or linear feed rate thereof; a grooved roller assembly (when forming an applied fin "G" tube) to materially improve the material flow distribution during grooving; and a fin forming assembly which deforms the finning material to permit the use of thinner finning material and which compensates for fluctuations between feed rates of the finning material and rotational speed of the tube or presentation rate of the grooved tube to the deforming finning material during fin swageing. In accordance with the apparatus and process of the present invention, finned tubes are manufactured at substantially increased rotational speeds thereby effecting cost reductions as great as about twenty-five percent (25%) at like raw material costs. Another aspect of the present invention is the capability of integration of such apparatus and process with continuous tube feeding and removal assemblies, a continuous tube welding assembly and a finned tube cutting assembly thereby to produce a finned tube of any desired length or configuration, or a finned tube having a preselect length of fins followed by a preselect length of bare tubes.

BRIEF DESCRIPTION OF THE DRAWINGS

A more complete understanding of the novel apparatus and process of the present invention will be had by reference to the following description when taken with the accompanying drawings wherein like numerals designate like parts throughout and wherein.

DETAILED DESCRIPTION OF THE INVENTION

One aspect of the present invention is the tube feed assembly to provide for the synchronization between the rotational speed of a bare tube to be processed and its rate of feed through the apparatus to reduce, if not substantially eliminate, slippage between elements, thereby to more accurately control finning and fin pitch. Another aspect of the present invention is the grooved roller assembly which includes at least three grooving rollers to distribute pressures (and thus temperatures) generated by the grooving process over a wider area of the tube surface and thereby reduce stress and permit substantially increased rotational speeds for extended production runs at reduced grooved roller replacement intervals with a resultant substantial increase in production rates. Still another aspect of the present invention is the pairing of a profiled drive roller with a pressure disc for deforming the continuous strip of finning material (usually aluminum) into a helical coil prior to wrapping or insertion and swageing of the deformed fin about the tube (fin "L" tube) or into a rolled groove (applied fin "G" tube).

Figure 1:
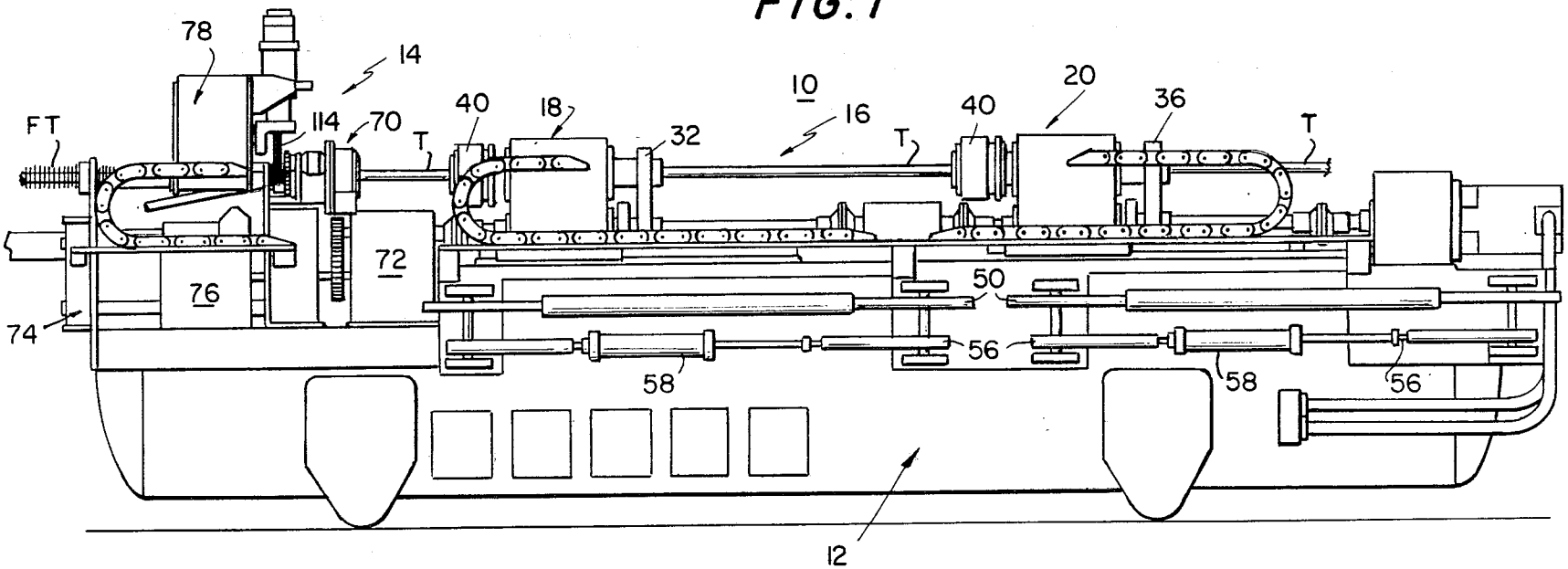
FIG. 1 is a side elevational view of the tube finning assembly.
Figure 2:
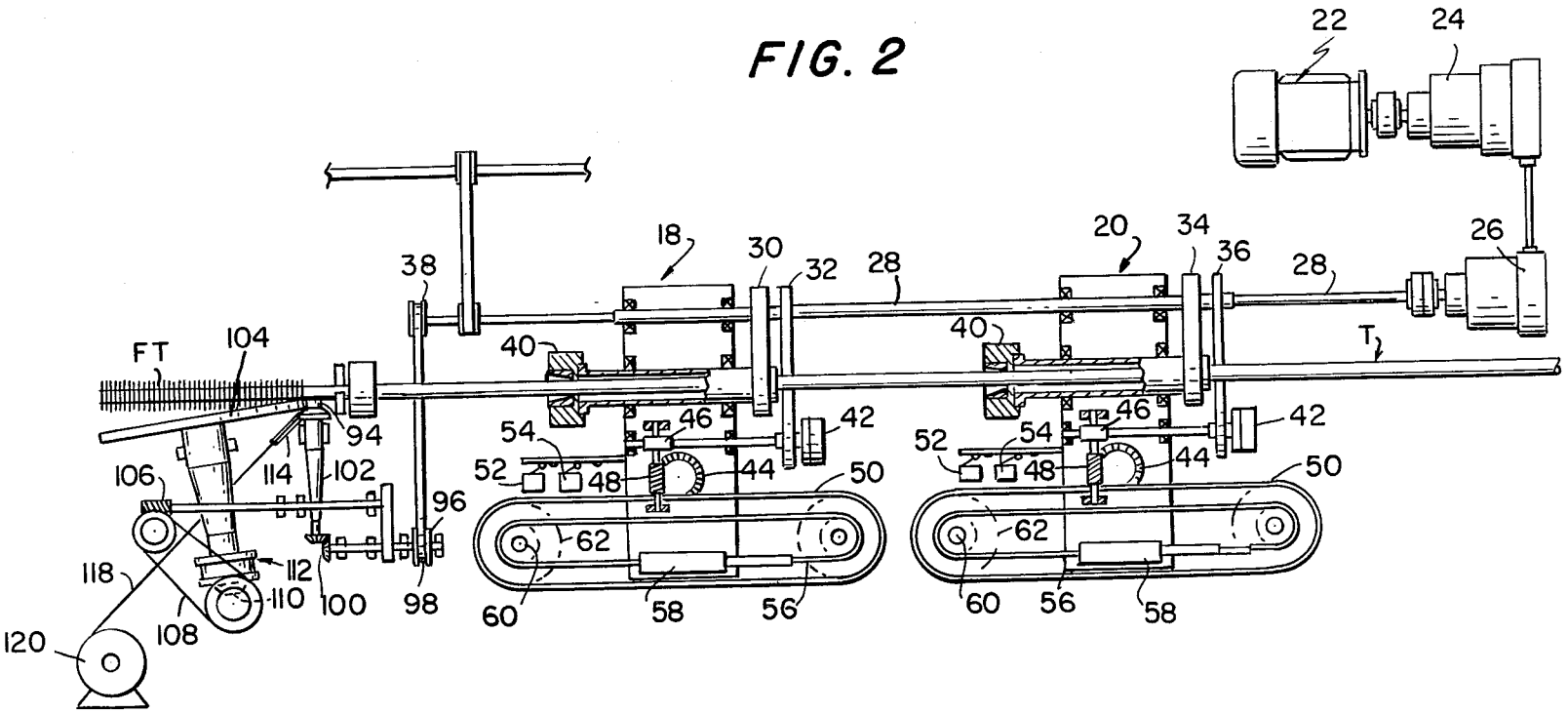
FIG. 2 is a partially schematic and sectional top elevational view of the tube finning assembly.

Referring now to FIGS. 1 and 2, there is illustrated a tube finning apparatus of the present invention, generally indicated as 10, comprising a tubular main frame, generally indicated as 12, supporting a finning head assembly and a tube feed drive assembly, generally indicated as 14 and 16 respectively. The tube feed drive assembly 16 comprises two tube feeding units, generally indicated as 18 and 20. The tubular main frame also supports main drive motor and service functions including hydraulic control modules, hydraulic fluid reservoir, electrical switchgear wiring and main drive line for the tube finning apparatus 10, as more fully hereinafter described.

According to each user's requirements, the tube finning apparatus 10 can be equipped with lifting points (not shown) for cranage or can be skid-mounted for mobility. Thus, the tube finning apparatus 10 of the present invention is a fully portable unit capable of "on-site" or factory usage. In a particularly preferred form, the tube finning apparatus 10 is integrated with a bare tube rack assembly.

As shown in FIG. 2, the tube finning apparatus 10 is provided with a prime mover, generally indicated as 22, such as an A.C. Squirrel cage motor coupled to a variable output pump 24 in fluid communication with a hydraulic motor 26, operated, for example, at a line pressure of about 150 bars. Power from the hydraulic motor 26 is transmitted to the tube finning assembly by a main drive shaft 28 having power take-off devices 30 and 32 and 34 and 36 for the tube feed units, generally denoted as 18 and 20, respectively, and power take-off device 38 for the finning head assembly 14. In this connection, all inter-related units are driven by positive mechanical methods, i.e., gears, toothed belts or chain drives preferably of the toothed belt types, to ensure 100% synchronization between the rotation of the bare tube and its axial rate of travel.

The power take-off devices 30 and 34, e.g., interchangeable pulleys, drive hollow spindles of each tube feed unit, 18 and 20, and by changing such pulleys 30 and 34, this permits variations in rotational speeds of the spindles which, when combined with a constant linear tube feed rate, thereby alter fin pitch. In such manner, fin pitch may be varied, for example, of from 5 to 11 fins per inch. Thus, by relating linear tube feed rate to fin pitch, constant production rates are obtained for all finned tubes.

Tube lengths and/or continuous tubing (T) are continuously passed through the hollow spindles of the respective tube feed units 18 and 20 and wherein the tube lengths are sequentially gripped by the hydraulically-operated collet chuck assembly 40, as more fully hereinafter discussed. Each of the tube feed units 18 and 20 reciprocates in a co-ordinated manner in a forward feed and rapid return sequence to achieve uninterrupted axial movement of tube lengths (T). In this regard, either or both of the collet chuck assemblies 40 of the respective tube feed units are in continuous engagement with tubing in operational mode. Thus, when neither of the collet chuck assemblies 40 is in simultaneous engagement with a tube (T), one collet chuck assembly 40 is being operated in the forward tube feed while the other collet chuck assembly 40 is being operated in a rapid return sequence. To ensure for more positive feed and pitch accuracy, after rapid return and prior to tube gripping, each collet chuck assembly 40 is caused to rotate to preferably achieve substantially the identical rotational velocity to that of the tube being processed prior to the clamping or gripping of the tube by such collet chuck assembly 40.

When either of the collet chuck assemblies 40 is caused to close, an air operated clutch 42 driven by pulleys 32 or 36 is caused to engage, completing a drive to a sprocket 44 via a double reduction worm gear 46 and 48 associated with the respective tube feed units 18 and 20. The sprocket 44 is caused to engage an endless chain 50 acting as a rack to cause the respective tube feed unit to be moved towards the tube finning head assembly, thereby linearly passing the tube (T) to and through the tube finning head assembly 14, as more fully hereinafter discussed.

Each of the tube feed units 18 and 20 is provided with limit switches 52 and 54, respectively, activated by the collet chuck assembly 40 of each of the tube feed units. An endless chain 56 of each tube feed unit is connected to a piston rod of a hydraulic cylinder 58 mounted to each of the tube feed units to effect rapid return of the collet chuck assembly 40 of each tube feed unit. Each of the endless chains 56 is caused to course over a sprocket 60 of a free wheel mechanism 62.

Figure 5:
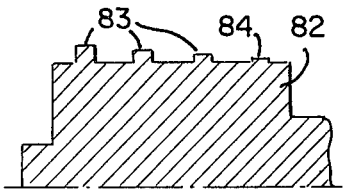
FIG. 5 is a partially enlarged sectional view of the grooved roller of the groove roller assembly.
Figure 3:
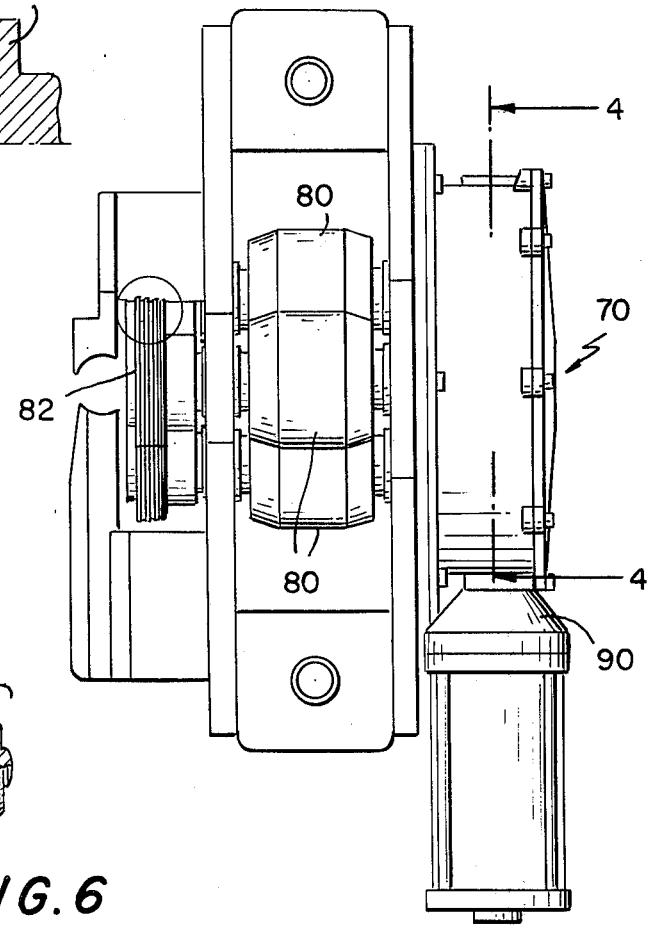
FIG. 3 is a side elevational view of the groove roller assembly of the finning head assembly.
Figure 4:
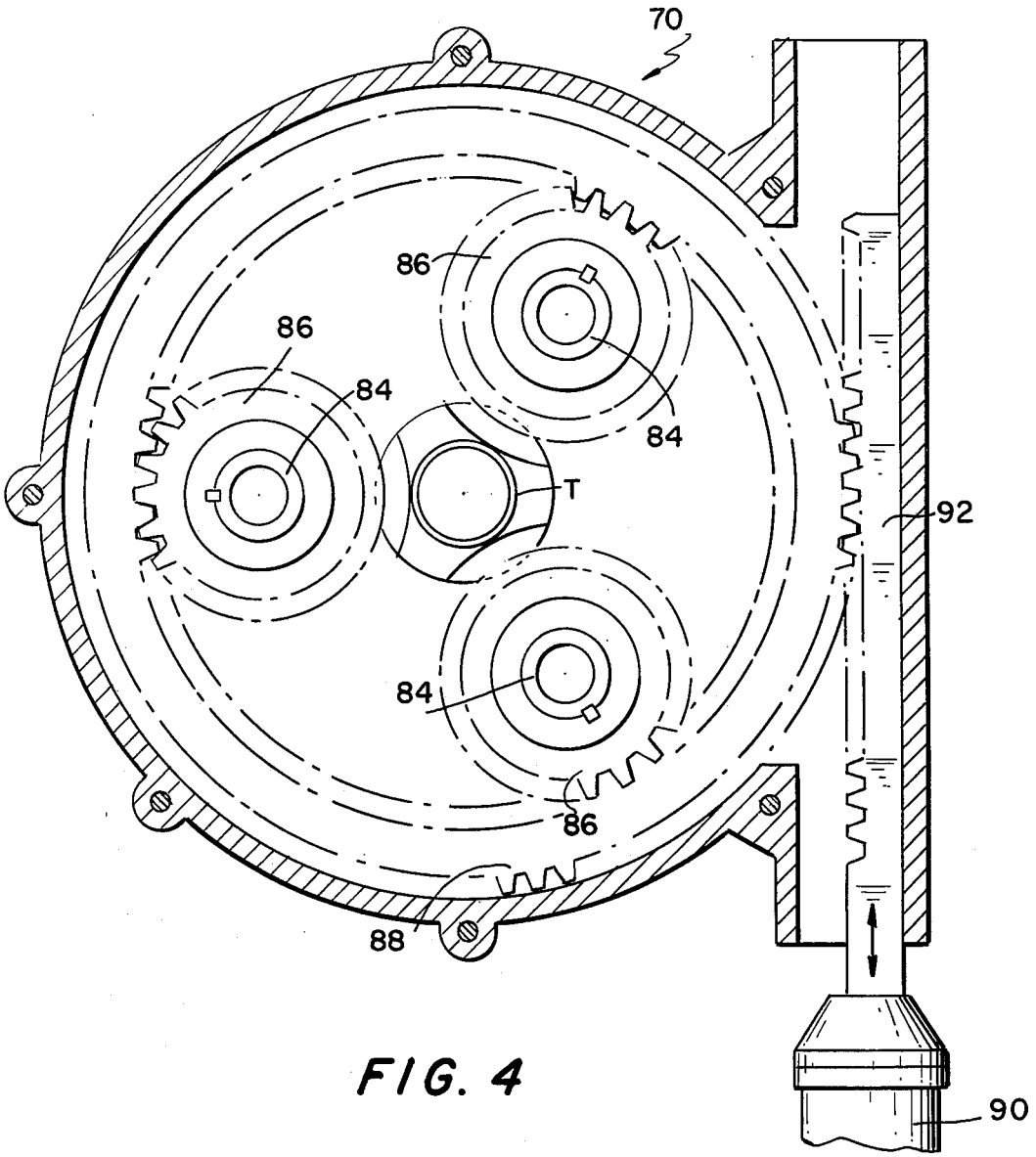
FIG. 4 is an enlarged sectional view of a portion of the groove roller assembly taken along the line III—III of FIG. 3.

The tube finning head assembly 14, referring to FIG. 1, comprises a grooved roller assembly 70; end frames 72 and 74; a lower slide assembly 76; and an upper slide assembly 78; all of which are positioned to form an integral assembly which may be readily detached from the main frame 12 for servicing. The grooved roller assembly 70, referring to FIGS. 3 and 4, has the dual functions of: (1) providing three-point support to the bare tube (T) by rollers 80, as near as possible to the tube finning operation as practical; and (2) providing grooving rollers 82 formed with concentric rings 83 of varying height (See FIG. 5) for rolling a helical groove into the bare tube necessary for the manufacturing of an applied fin "G" tube. The grooving rollers 82 are mounted on eccentric shafts 84 (FIG. 4) supported by needle thrust bearings (not shown). In operation, the eccentric shafts 84 are rotated through 90° by gears 86, driven by a ring gear 88, which, in turn, is operated by a hydraulic cylinder 90 via a rack 92. Activation of the hydraulic cylinder 90 causes the grooving rollers 82 to be forced into the surface of the bare tube, thereby causing a groove to be helically generated in the outer surface thereof as the tube is caused to rotate within the grooved roller assembly 70.

The grooving rollers 82 of the grooved roller assembly 70 form the helical groove in the bare tube when manufacturing applied fin "G" tubes, whereas, in the production of wrapped fin "L" or "LL" tubes, the grooving function is isolated by retraction of the grooving rollers 82 from contact with the bare tube by operation of the hydraulic cylinder 90, but continues to permit the support rollers 80 of the grooved roller assembly 70 to remain in contact to support the bare tube during finning of a wrapped "L" or "LL" tube. It will be understood that the grooved roller assembly 70 is actuated by the machine control system to groove only that portion of a tube desired to be finned in accordance to the use application of the thus-produced finned tube.

Figure 6:
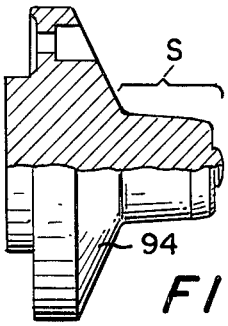
FIG. 6 is a side elevational view, partially in section of the drive roller of the finning head assembly.
Figure 7:
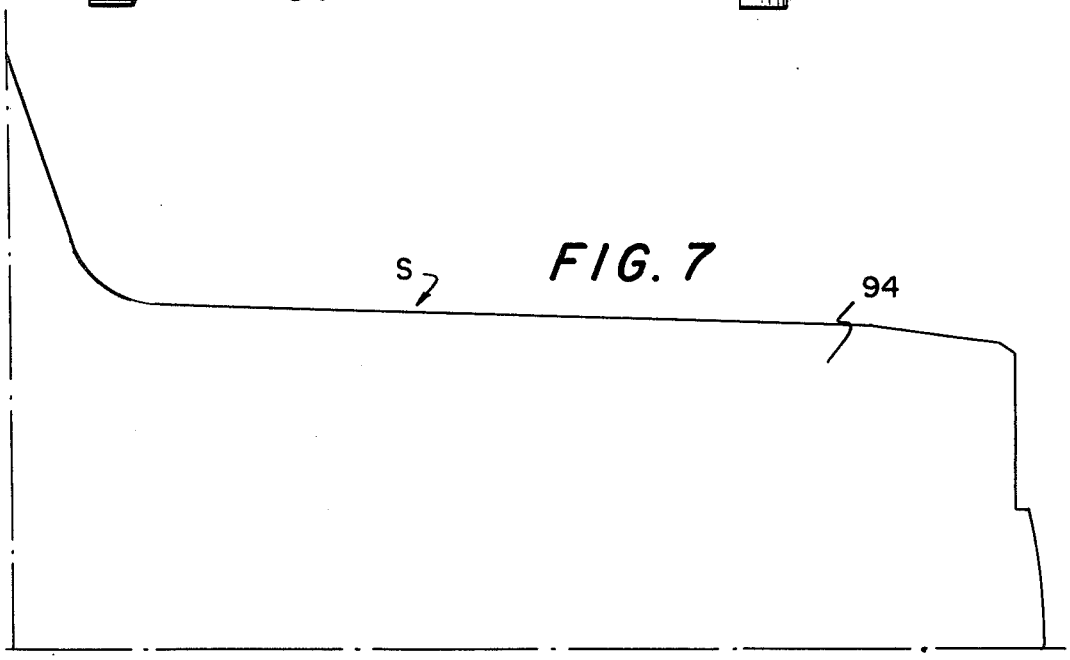
FIG. 7 is an enlarged view of the contoured surface of the drive roll of FIG. 6.

The end frame 72 (FIG. 1) houses (1) a drive assembly for a small, profiled drive roller 94 (FIG. 6) of a deforming roller set which cooperates to deform the finning material, as more fully hereinafter described, and (2) hydraulic cylinders for applying pressure for the fin deforming process. The drive roller 94 is preferably essentially of constant dimension for all fin pitches, and has a surface(s) profiled (see FIG. 7) to assist in fin deformation wherein asymmetrical deformation is effected between the deforming roller set by creating differences in the rate of metal flow across the width of the strip of finning material by compressing the outer edge of the strip of finning material more than the inner edge, thereby forming the strip into a helical coil. The drive roller 94 (FIG. 2) of the endframe 72 is caused to rotate via a speed motor 96 by a toothed belt pulley 98 driven by the power take-off device 38, mounted on the main drive shaft 28 and transmitting power via bevel gears 100 to a spindle 102 on which is mounted the drive roller 94.

The end frames 72 and 74 are coupled by guide bars which also support the lower slide assembly 76. The lower slide assembly 76 (FIG. 1) houses a pressure disc 104 which together with the drive roller 94 forms the deforming roller set used for deforming the continuous strip of finning material into the coiled helical form. (See FIG. 2) The pressure disc 104 is driven from the main drive shaft 28 via the power take-off device 38 transmitting the drive via a worm gear 106, belt drive 108, bevel gear 110, and a free-wheel coupling, generally indicated as 112. The free-wheel coupling 112 is provided to ensure that drag does not occur as a result of non-synchronization between the drive roller 94 and the pressure disc 104 which begins to free-wheel after 2 to 3 revolutions thereof. In the event of slippage, direct drive is immediately restored.

The upper slide assembly 78 is provided with finning discs, generally indicated as 114. Such finning discs 114 have a dual function according to the type of fin tube produced, i.e., when producing an applied fin "G" tube, such discs 114 effect swageing to bond the fin root to the tube being processed (such as discussed in the McElroy patents) or, as when producing a wrapped fin "L" or "LL", the finning discs 114 are used to straighten-out or iron-out the deformed finning material to ensure substantially perpendicular relationship thereof with two axes and to straighten-out any wrinkles introduced during deformation of the finning material. It is to be understood that the finning discs 114 are to be individually contoured in accordance with the type of finned tube being manufactured. A continuous strip 118 of finning material, generally aluminum, from a supply spool roller 120 is caused to be introduced between the deforming roller set formed by the drive roller 94 and the pressure disc 104 for deformation to form the fin to be wrapped about the tube or swaged into a groove formed in the tube, depending on the tube production requirements.

In operation, pre-straightened tubes from a bare tube rack (not shown) are released at intervals signaled from the control system to coincide with the completion of the preceding finned tube at the finning stage. Generally, it is contemplated that the capacity of such a bare tube rack would be in the order of about 50 tubes to permit at least one hour's production at 100% output prior to re-loading of the tube magazine. After release, each bare tube is caused to roll under the influence of gravity into a tube loading attachment (not shown) on the feed side of the tube finning apparatus 10.

Such a tube loading attachment is a slide-mounted unit, travelling on circular guideways providing an allowable axial movement of, for example, 1,500 mm, effected by a hydraulic cylinder. Incorporated in such slide-mounted unit, collet chuck 40 may be mounted on a spindle driven from the main drive shaft 28 of the tube finning apparatus 10 at a speed synchronized to that of the rotational speed of the tube being finned. At such point, the tube loading attachment is caused to rapidly traverse by a hydraulic cylinder to move the bare tube to a point where an end of the tube is at a pre-selected distance from the preceding tube and is maintained at such pre-selected distance while the tube ends are welded together by an annular induction welding device attached to a tube welding unit (not shown). Upon completion of the welding process, the tube loading attachment would release its grip on the tube and be caused to return to a starting position at which the tube loading attachment would rest until initiation of a subsequent cycling. Alternately, the slide mounted unit is caused to move the new tube into contact with the tube being finned at such pre-selected distance and under a contact whereby frictional forces cause said new tube to rotate with the tube being finned during welding. After welding, the continuous tube is caused to pass to the tube finning apparatus 10 as hereinabove discussed, and the tube feed units 18 and 20 are caused to effect rapid traverse and feed movements in both forward and reverse directions.

The tube finning apparatus of the present invention is designed to operate on a continuous work cycle arranged in two versions, i.e., a standard version for manual loading and unloading of the bare tube and finned tube, respectively, and an automatic version of finning a continuous tube wherein additional facilities are provided to sever the aluminum strip (fin) at pre-select intervals together with capabilities to interrupt the finning process and afford an opportunity to control the lengths of tubes left unfinned, thereby allowing savings in material and labor costs that would be necessary for stripping fins from finned tubes as a secondary operation.

The tube finning apparatus 10 of the present invention includes a main control panel preferably situated near the tube finning head assembly 14 to permit constant operator observation and monitoring of the finning process, thereby readily permitting assumption of manual control for time and setting purposes.

Referring again to the tube feed units 18 and 20, of the tube finning assembly 10, the collet chuck assembly 40 of the tube feed unit 18 (assuming start-up) is caused to close by the air-operated clutch 42 driven by a pulley from take-off device 32 to complete engagement between the drive to the sprocket 44 via a double reduction worm drive 46 and 48. The sprocket 44 is caused to engage the endless roller chain 50 acting as a rack to cause the tube feed head 18 to move forward, thereby continuously feeding the bare tube into the grooved roller assembly unit 70 of tube finning head assembly 14 with activation of the grooving rollers 82 into tube contact in the production of a fin "G" tube. Such forward movement motion is continued until the limit switch 54 is activated to cause collet chuck assembly 40 of the tube feed unit 20 to be energized and thereby rotated with the subsequent gripping of the bare tube with the same forward movement concurrently with the collet chuck assembly 40 of the tube feed unit 18 under the action of the clutch 42.

Simultaneous forward movement by the collet chuck assembly 40 is continued until the limit switch 52 of the tube feed unit 18 is activated, thereby disengaging the collet chuck assembly 40 and clutch 42 of such tube feed unit 18, thereby halting the forward motion thereof. The hydraulic cylinder 58 mounted to the tube feed unit 18 has an end of its piston connected to the chain 56 which is caused to operate to return the tube feed unit 18 in rapid traverse to a starting position. The chain 56, which moves over sprockets 60 affixed to the free-wheeled mechanism 62, allows free movement in one direction and permits for the return of the piston of the hydraulic cylinder 58 after completion of the operation. The tube feed assembly 18 will remain at rest until the cycle is re-initiated by tube feed head unit 20 activating limit switch 52 associated therewith, it being understood that the tube feed unit 20 is operated in a manner similar to that of tube feed unit 18.

Engagement of the bare tube (T) by the grooving rollers 82 formed with the spaced apart concentric rings 83 causes a groove to be rolled into the surface of the tube impressed therein by hydraulic pressure. The strip 118 of the finning material from the supply roller 120 is caused to be passed through the deforming roller set comprising the drive roller 94 and pressure disc 104 wherein the strip is compressed, as hereinabove discussed, to provide a helical coil, the base of which is introduced into the thus-formed groove and is ultimately swaged into such groove by the finning discs 114 (FIG. 1) rotating in the upper slide assembly 78 actuated by a hydraulic cylinder which enables such finning discs 114 to be selectively retracted at any point during the finning process. The upper slide assembly 78 is mounted on a slide and is operated by a hydraulic cylinder to permit the withdrawal of the upper slide assembly 78 for access to the finning head required for altering the finning discs, dependent on the fins being applied to the tube being processed.

The thus-produced finned tube (FT) is withdrawn from the tube finning apparatus 10 (assuming unit tube feed) and is transported to a finished tube rack (not shown) having a storage capacity of about 50 finned tubes, which capacity would permit hourly servicing to remove finished tubes as well as to replenish the magazine in the supply or bare tube rack. It will be understood that lesser intervals are generally required to replace the finning material on the supply roller 120. It is understood that, for continuous finned tube production, the finned tube (FT) is severed at pre-select intervals prior to transportation to the finished tube rack.

As hereinabove discussed, the forward feed of a bare tube during the finning process is achieved by two reciprocating tube feed units 18 and 20 mounted on circular guideways attached to the main frame 12. Assuming the processing of 10 meter tubes (generally standard in the industry), each tube feed unit would have an axial travel of about 5.0 meters with forward movement being achieved by the rack and pinion drive using a ½ inch pitch tri-plex chain 50. To minimize inaccuracies and pitch errors caused through chain wear, a pre-tensioning device (not shown) would automatically maintain tension in the chains 50 at all times. The forward transverse feed rate for a tube feed unit would be in the order of about 6.96 meters per minute with the rapid return traverse rate in the order of 20 meters per minute. Thus, forward traverse is effected in about 4.33 seconds with return traverse being effected in about 2.66 seconds.

The tube drive assembly 16, as hereinabove described, includes two tube feed units 18 and 20 which are independently operated but inter-relatedly driven (i.e., over-lapping) to ensure positive tube feed. In this regard, the tube clamping devices, i.e., the standard collet chuck assembly 40 clamping devices, are caused to begin to rotate prior to clamping to permit continuous and uninterrupted feed movement. The overall dimensions of the tube finning apparatus and related bare tube rack and tube finishing rack lend themselves to skid mounting and thus plant site location for "on-site" fabrication.

While the present invention is described with reference to fabrication of applied fin "G" tubes, the present invention is readily modified to the manufacture of wrapped "L" or "LL" tubes, and this is achieved by disengagement of the grooving rollers 82 from the bare tube, by replacement of the pressure disc 104 in the tube finning head assembly 14 and by suitable replacement of finning discs 114 as hereinabove discussed. The pitch of a fin tube formed in accordance with the present invention is readily changed by changing the diameter of the take-off pulleys 30 and 34 and thus altering the rotational speed of the tube being processed, considering a constant rate of tube advancement through the tube finning apparatus 10.

In accordance with the present invention, applied fin "G" tubes may be fabricated from a tube having a length of 10 meters and a diameter of 25.4 mm at rotational speed of up to 3000 rpm's utilizing an aluminum strip of reduced thickness, e.g., 0.40 mm, as compared with the thickness of 0.50 mm of aluminum strip material used in existing machines. Such a reduction in aluminum strip dimension represents a savings of about 22% per tube length, i.e., 10 meters, at a tube pitch of 11 fins per inch. Additionally, when manufacturing applied fin "G" tubes, less material is required as compared to existing machines, thereby resulting in a savings of aluminum costs of up to 70% over a wrapped "L" per tube length.

In accordance with the present invention, a fully compatible machine is capable of producing wrapped "L" and "LL" as well as applied fin "G" tubes at linear production rates of up to about 7.0 meters per minute as compared with contemporary machines which have a maximum output of about 4.6 meters per minute for wrapped "L" and "LL" finned tubes and about 2.0 meters per minute for applied fin "G" tubes.

As hereinabove discussed, the positive drive system of the present invention permits absolute control over the rotational speed of the tube and tube feed rate and, when combined with the improved design of the deforming roller set, in particular, the profile of the drive roller, which effects distribution of strip material flow across the strip width and directly influences the manner in which the fin forms the coil about the tube, thereby permits higher finned tube production rates at substantial cost reduction.

While the present invention has been described in connection with an exemplary preferred embodiment thereof, it will be understood that many modifications will be apparent to those of ordinary skill in the art and that this application is intended to cover any adaptations or variations thereof. Therefore, it is manifestly intended that this invention be only limited by the claims and the equivalents thereof.

What is claimed is:

1. An apparatus for forming a finned tube from a bare tube which comprises:

at least two tube feed units, each of said tube feed units having a bare tube clamping means;

means for rotating said bare tube clamping means, said bare tube clamping means being caused to rotate prior to clamping of said bare tube;

sprocket and rack assembly means for linearly moving each of said tube feed units between a tube contact position and a tube release position;

means for returning said tube feed units from said tube release position to said tube contact position, said means for moving and returning said tube feed units being synchronized in a manner to continuously move said bare tube through said apparatus;

means for supplying a strip of a finning material;

means for deforming said strip of finning material into a helical coil;

means for forming said helical coil about said bare tube; and means for supporting said tube during forming of said fin about said bare tube.

2. The apparatus as defined in claim 1 wherein each of said feed units include switch means for placing the other tube feed unit in operational mode and a switch means for deactivating said each of said tube feed units to cause said each of said tube feed units to return to said tube contact position.

3. The apparatus as defined in claim 1 wherein said means for rotating said tube clamping means rotates said clamping means to about the same rotational speed as said bare tube.

4. The apparatus as defined in claim 1 wherein said bare tube clamping means is an air-operated collet chuck.

5. The apparatus as defined in claim 1 wherein said means for moving each of said tube feed units includes drive means for rapidly returning said tube feed unit to said tube contact position after reaching said tube release position.

6. The apparatus as defined in claim 5 wherein said drive means for rapid return includes an endless chain operatively connected to a hydraulic cylinder.

7. The apparatus as defined in claim 1 wherein said means for deforming said finning material effects deformation thereof for subsequent forming of a wrapped "L" finned tube and wherein said forming means are ironing discs.

8. The apparatus as defined in claim 1 wherein said means for deforming said finning material effects deformation thereof for subsequent forming of a wrapped "LL" finned tube and wherein said forming means are ironing discs.

9. The apparatus as defined in claim 1 and additionally comprising grooving roller means for forming a helical groove in said bare tube, said grooving roller means comprising at least three symmetrically-disposed grooving rollers and wherein said deforming means effects asymmetric deformation over the width of said finning material and wherein said forming means are discs for swageing asymmetrically deformed finning material into said thus-formed groove.

10. The apparatus as defined in claim 9, wherein said grooving rollers are formed with a plurality of concentric rings of varying height.

11. The apparatus as defined in claim 1 wherein said deforming means is a roller set comprised of a pressure disc and a profiled drive roller.

12. The apparatus as defined in claim 11 wherein said pressure disc includes drive means for compressing the outer edge of said strip of finning material more than the inner edge thereof.

13. The apparatus as defined in claim 11 wherein the profiled drive roller is the same for all types of finned tubes being formed and wherein said pressure disc is changed dependent on the finned tube being formed.

14. The apparatus as defined in claim 11 wherein said pressure disc is mounted for rotation on a shaft coupled to a free-wheeling coupling to permit synchronization between said pressure disc and said profiled drive roller.

15. The apparatus as defined in claim 1 wherein said means for moving said bare tube through said apparatus moves said bare tube at a constant linear velocity and wherein said means for rotating said bare tube is varied thereby to alter fin pitch of the thus-formed finned tube.

16. The apparatus as defined in claim 1 wherein said apparatus includes a prime mover having a drive shaft from which each rotating, moving and forming means derives power via positive mechanical coupling means.

17. The apparatus as defined in claim 1 wherein said means for supporting said bare tube during forming includes symmetrically disposed rollers.

18. In an assembly for forming a finned tube from a bare tube, an improved tube drive assembly for introducing said bare tube into a finning head assembly which comprises:

a first tube feed unit including bare tube clamping means;

means for rotating said bare tube clamping means of said first tube feed unit prior to the clamping thereof about said bare tube;

sprocket and rack assembly means for moving said first tube feed unit from a tube contact position to a tube release position;

means for returning said first tube feed unit from said tube release position to said tube contact position;

a second tube feed unit including bare tube clamping means;

means for rotating said bare tube clamping means of said secind tube feed unit prior to the clamping thereof about said bare tube; and sprocket and rack assembly means for moving said second tube feed unit from a tube contact position to a tube release position;

means for returning said second tube feed unit from said tube release position to said tube contact position, movement of said first and second tube feed units being synchronized in a manner to continuously introduce said bare tube into said finning head assembly.

19. The apparatus as defined in claim 18 wherein each of said feed units include switch means for placing the other tube feed unit in operational mode and a switch means for deactivating said each of said tube feed units to cause each of said tube feed units to return to said tube contact position.

20. The apparatus as defined in claim 18 wherein said means for rotating said tube clamping means rotates said clamping means to about the same rotational speed as said bare tube.

21. The apparatus as defined in claim 18 wherein said bare tube clamping means is an air-operated collet chuck.

22. The apparatus as defined in claim 18 including drive means for rapidly returning said tube feed units to said tube contact position after reaching said tube release position.

23. The apparatus as defined in claim 22 wherein said means for rapid return includes an endless chain operatively connected to a hydraulic cylinder.

24. The assembly as defined in claim 18 wherein said rotating and moving means for said tube feed units derive power via positive mechanical coupling means.

25. An apparatus for forming a finned tube from a bare tube which comprises:

at least two tube feed units, each of said tube feed units having a bare tube clamping means;

means for rotating said bare tube clamping means, said bare tube clamping means being caused to rotate prior to clamping of said bare tube;

sprocket and rack assembly means for linearly moving each of said tube feed units between a tube contact position and a tube release position;

means for returning said tube feed units from said tube release position to said tube contact position, said means for moving and returning said tube feed units being synchronized in a manner to continuously move said bare tube through said apparatus;

means for deforming said strip of finning material into a helical coil including a roller set comprised of a pressure disc and a profiled drive roller, said pressure disc having drive means for compressing the outer edge of said strip of material more than the inner edge thereof and mounted for rotation about a shaft coupled to a free-wheeling coupling to permit synchronization of said pressure disc with said profiled drive roller;

means for forming said helical coil about said bare tube; and means for supporting said tube during forming of said fin about said bare tube.

26. An apparatus for forming a fin "G" tube from a bare tube which comprises:

at least two tube feed units, each of said tube feed units having a bare tube clamping means;

means for rotating said bare tube clamping means, said bare tube clamping means being caused to rotate prior to clamping of said bare tube;

sprocket and rack assembly means for linearly moving each of said tube feed units between a tube contact position and a tube release position;

means for returning said tube feed units from said tube release position to said tube contact position, said means for moving and returning said tube feed units being synchronized in a manner to continuously move said bare tube through said apparatus;

grooving roller means for forming a helical groove in said bare tubes, said grooving roller means comprising at least threesymmetrically-disposed grooving rollers formed with a plurality of concentric rings of varying height;

deforming means for asymmetrically deforming said strip of finning material into a helical coil including a roller set comprised of a pressure disc and a profiled drive roller, said pressure disc having drive means for compressing the other edge of said strip of material more than the inner edge thereof and mounted for rotation about a shaft coupled to a free-wheeling coupling to permit synchronization of said pressure disc with said profiled drive roller;

disc means for swageing said helical coil of finning material into said helical groove; and means for supporting said tube during swageing of said helical coil of finning material into said helical groove formed in said bare tube.

* * * * *